US005618624A

United States Patent [19]

Dinger et al.

[11] Patent Number: 5,618,624

[45] Date of Patent: Apr. 8, 1997

[54] FORMABLE, HEAT-STABILIZABLE TEXTILE PILE MATERIAL

[75] Inventors: Rolf Dinger, Grossaitingen; Joachim Wiegand, Bobingen; Armin Fendt, Graben, all of Germany

[73] Assignee: Hoechst Trevira GmbH & Co. KG, Germany

[21] Appl. No.: 605,785

[22] Filed: Feb. 22, 1996

[30] Foreign Application Priority Data

Feb. 22, 1995 [DE] Germany ..... 195 06 037.7

[51] Int. Cl.[6] ..... B32B 3/02; B32B 9/00; D02G 3/02

[52] U.S. Cl. ..... 428/368; 428/92; 428/93; 428/97; 428/397; 57/244; 57/245

[58] Field of Search ..... 428/92, 93, 94, 428/97, 368, 397; 57/244, 245

[56] References Cited

U.S. PATENT DOCUMENTS

| | | | |
|---|---|---|---|
| 3,839,135 | 10/1974 | Lowry et al. | 428/93 |
| 4,340,631 | 7/1982 | Endo et al. | 428/92 |
| 4,617,208 | 10/1986 | Cadenhead, Sr. | 428/92 |
| 4,697,407 | 10/1987 | Wasserman | 428/372 |
| 4,705,706 | 11/1987 | Avery . | |
| 4,712,366 | 12/1987 | Tsujimoto et al. | 57/245 |
| 4,818,318 | 4/1989 | McMahon . | |
| 4,874,563 | 10/1989 | McMahon . | |
| 4,874,666 | 10/1989 | Kubo et al. | 428/397 |
| 5,032,333 | 7/1991 | Bankar . | |
| 5,071,705 | 12/1991 | Tanaka et al. | 428/370 |
| 5,305,813 | 4/1994 | Poole . | |
| 5,366,797 | 11/1994 | Rotgers . | |
| 5,536,551 | 7/1996 | Woosley | 428/95 |

FOREIGN PATENT DOCUMENTS

| | | |
|---|---|---|
| 2007067 | 7/1990 | Canada . |
| 1323488 | 10/1993 | Canada . |
| 2094875 | 11/1993 | Canada . |
| 3408769 | 9/1985 | Germany . |
| 4042063 | 7/1992 | Germany . |
| WO94/20657 | 9/1994 | WIPO . |

OTHER PUBLICATIONS

Patent Abstracts of Japan, vol. 14, No. 74 (C–0687, Feb. 13, 1990 & JP–A–01 292139 (Kuraray Co. Ltd), Nov. 24, 1989.
Derwent Abstract 92/226996/28 (DE–A 4042063).
Derwent Abstract 85/249942 (DE–A 3408769).
Derwent Abstract 85–249942 (DE 3408769).
Derwent Abstract DW 84–078843 (JP–OS–30937).
Derwent Abstract DW 93–024299 (JP–A 04/353525).
Derwent Abstract 89–294412 (EP–A 0336507).

*Primary Examiner*—Terrel Morris
*Attorney, Agent, or Firm*—Connolly & Hutz

[57] ABSTRACT

The present invention relates to a pile material composed of a textile backing composed of a knit or woven and bound-in loop-forming pile yarns, the textile backing consisting of a multifilament hybrid yarn composed of a mixture of lower melting and crimped higher melting filaments, said pile material being capable of three-dimensional deformation and having a backing which can be consolidated by heat treatment. The pile material of the invention has a pleasantly soft, textile hand and can be used for example as cover for seating or for textile surface decoration of complicatedly styled contours, for example the inner surface of motorcar-doors.

10 Claims, No Drawings

FORMABLE, HEAT-STABILIZABLE TEXTILE PILE MATERIAL

The present invention relates to a pile material composed of a textile backing composed of a knit or woven and bound-in loop-forming pile yarns, the textile backing consisting of a multifilament hybrid yarn composed of a mixture of lower melting and crimped higher melting filaments, said pile material being capable of three-dimensional deformation and having a backing which can be consolidated by heat treatment. The pile material of the invention has a pleasantly soft, textile hand and can be used for example as cover for seating or for textile surface decoration of complicatedly styled contours, for example the inner surface of motorcar-doors.

Sheet materials composed of hybrid yarns composed of lower melting and higher melting fibre materials and consolidatable by heat treatment are already known. For instance, EP-B-0359436 discloses louvre blinds where the louvre strips are of a fabric comprising lower melting and higher melting yarns, said fabric, once produced, being subjected to a heat treatment which causes the lower melting yarn components to melt and stiffen the fabric.

It is also known to use hybrid yarns having a high-melting or unmeltable filament content and a thermoplastic lower-melting filament content to produce sheet materials which, by heating to above the melting point of the thermoplastic, lower-melting yarn component, can be converted into fiber-reinforced, stiff thermoplastic sheets, a kind of organic sheet-metal.

Various ways of producing a fiber-reinforced thermoplastic sheet stock are described in Chemiefasern/Textiltechnik Volume 39/91 (1989) pages T185 to T187, T224 to T228 and T236 to T240. The production starting from sheetlike textile materials composed of hybrid yarns is described there as an elegant way, which offers the advantage that the mixing ratio of reinforcing and matrix fibers can be very precisely controlled and that the drapability of textile materials makes it easy to place them in press molds (Chemiefasern/Textiltechnik Volume 39/91 (1989), page T186).

As revealed on page T238/T239 of this publication, however, problems arise when the textile materials are to be deformed in two dimensions. Since the extensibility of the reinforcing threads is generally negligible, textile sheets composed of conventional hybrid yarns can only be deformed because of their textile construction.

However, this deformability generally has narrow limits if creasing is to be avoided (T239), an experience that was confirmed by computer simulations.

The solution of pressing textiles composed of reinforcing and matrix threads in molds has the disadvantage that partial squashing occurs, which leads to a dislocation and/or crimping of the reinforcing threads and an attendant decrease in the reinforcing effect.

A further possibility discussed on page T239/T240 of producing three-dimensionally shaped articles having undislodged reinforcing threads would involve the production of three-dimensionally woven preforms, which, however, necessitates appreciable machine requirements, not only in the production of the preforms but also in the thermoplastic impregnation or coating.

Improved deformability of reinforcing layers is the object of a process known from DE-A-40 42 063. In this process, longitudinally deformable, namely heat-shrinking, auxiliary threads are incorporated into the sheet material intended for use as textile reinforcement. Heating releases the shrinkage and causes the textile material to contract somewhat, so that the reinforcing threads are held in a wavy state or in a loose embrace.

DE-A-34 08 769 discloses a process for producing shaped fiber-reinforced articles from thermoplastic material by using flexible textile structures consisting of substantially unidirectionally aligned reinforcing fibers and a matrix constructed from thermoplastic yarns or fibers. These semi-finished products are given their final shape by heatable profile dies by melting virtually all the thermoplastic fibers.

European Patent Application EP-A-0 260 872 discloses a tufted textile material wherein pile yarns are tufted into a primary backing composed of a nonwoven containing relatively low-melting yarns. A heat treatment of the tufted material melts the lower-melting fibrous constituents of the nonwoven backing, consolidating the backing and binding the pile yarns therein.

European Patent Application EP-A-0 568 916 discloses a tufted textile material wherein pile yarns containing low-melting fibers are tufted into a multilayered primary backing. A specific heat treatment, which affects only the backing of the tufted material, melts the lower-melting constituents of the pile yarns and binds them into the backing. A special pile-side layer of the multilayered backing at the same time provides thermal insulation to prevent any harshening of the pile yarns.

Japanese Patent Offenlegungsschrift 30 937/1984 discloses a pile material composed of a woven base into which the pile yarns are bound. The woven base consists of a yarn composed of lower-melting and higher-melting fibers. Following the production of the woven and binding in of the pile, the material is heated to a temperature at which the lower-melting fibers melt, consolidating the woven backing. The example given in this document reveals that the yarn used for producing the woven backing is a staple fiber yarn obtained from a mixture of lower-melting and higher-melting staple fibers by secondary spinning.

However, these documents provide no information for the production of a pile material which is deformable, i.e. suitable for covering complicatedly shaped three-dimensional surfaces.

German Patent Application P 42 09 970.6 proposes producing a structural plush from a knitted backing and pile yarns bound into it in a pattern by using polyester yarns for preference. However, the materials described therein cannot be thermoconsolidated and their deformability is limited to the extent resulting from the knitted structure of the backing.

Hybrid yarns composed of unmeltable (e.g. glass or carbon fiber) and meltable fibers (e.g. polyester fiber) are known. For instance, the Patent Applications EP-A-156 599, 156 600, 351 201 and 378 381 and Japanese Publication JP-A-04 353 525 concern hybrid yarns composed of non-meltable fibers, e.g. glass fibers, and thermoplastic, e.g. polyester, fibers.

EP-A-551 832 and DE-A-29 20 513 concern combination yarns which, although ultimately bonded, are first present as hybrid yarn.

European Patent EP-B-0 325 153 discloses a polyester yarn textile sheet material with a craquelé effect, which consists in part of cold-drawn, high-shrinking polyester fibers and in part of hot-drawn, normal-shrinking polyester fibers. In this material, the craquelé effect is brought about by releasing the shrinkage of the high-shrinking fibers.

EP-B-0 336 507 discloses a process for densifying a polyester yarn textile sheet material which consists in part of cold-drawn, high-shrinking polyester fibers and in part of hot-drawn, normal-shrinking polyester fibers. In this material, the densification is brought about by releasing the shrinkage of the higher-shrinking fibers.

EP-A-0 444 637 discloses a process for producing a crimped hybrid yarn from lower-melting and higher-melting filament yarns. In this process, first the higher-melting yarn is crimped in a texturing jet (a bulking jet as described in U.S. Pat. No. 3,525,134), then it is combined with the lower-melting yarn, and the two yarns are jointly crimped in a second texturing jet.

It is an object of the present invention to provide a pile material which has a pleasantly soft, "textile" hand, is producible in many appealing decors, possesses good drapability, can be three-dimensionally deformed and hence also adapted without creases to complicatedly shaped three-dimensional surfaces, such as, for example, seating and backrest areas of seats or the inner surface of motorcar doors, and whose backing can be consolidated and stiffened to an extent adapted to the requirements of further processing, by simply heating.

This object is achieved by the hereinafter described pile material of the present invention.

The present invention accordingly provides a pile material composed of a textile backing composed of a knit or woven and bound-in loop-forming pile yarns, the textile backing consisting of a multifilament hybrid yarn composed of at least 2 varieties A and B of filaments with or without cofilaments C, wherein said filaments A are textured and have a melting point above 180° C., preferably above 220° C., in particular above 250° C., said filaments B have a melting point below 220° C., preferably below 200° C., in particular below 180° C., the melting point of said filaments B being at least 20° C., preferably at least 40° C., in particular at least 80° C., below the melting point of said filaments A, and the weight ratio of said filaments A:B being within the range from 20:80 to 80:20, preferably from 40:60 to 60:40, and the multifilament hybrid yarn additionally containing up to 40% by weight of cofilaments C.

An essential advantage of this pile material is that it is capable of three-dimensional deformation. This useful property is particularly favored and even achieved when the backing is woven if the higher-melting textured filaments A of said multifilament hybrid yarn have a crimp of 3 to 50%, preferably of 8 to 30%, in particular of 10 to 22%.

The crimping of the higher-melting filaments can in principle be effected by all known methods in which a two- or three-dimensional crimp is set into the filaments at elevated temperature. Suitable known processes are for example stuffer box crimping, gear crimping, the knit-deknit process, wherein a yarn is first knitted up into a hose, heat-set in that form and then unraveled again. The preferred process for texturing the filaments A, however, is the false-twist process described in numerous publications.

Advantageously, the higher-melting textured filaments A are air jet textured or preferably false twist textured.

A further particularly useful property of the pile material of the present invention is that its backing can be consolidated by a heat treatment. In the course of the heat treatment, the lower-melting filaments B of the multifilament hybrid yarn of the textile backing form at least to some extent a matrix which interconnects the higher-melting textured filaments of the multifilament hybrid yarn to one another and to the pile yarn in the region of the plane of the backing.

A matrix for the purposes of this invention is a continuous polyester mass formed by the complete or partial melting of the filaments B or by a mutual adhering of the filaments B softened to the point of tackiness.

To obtain this possibility of consolidation without allowing undesirable losses in respect to strength, dimensional stability of the material under severe-duty conditions or with regard to textile hand and appearance of the pile, it is convenient and advantageous for the filaments A to have a melting point of above 220° C., preferably of 220° to 300° C., in particular of 240°–280° C. It is further convenient and advantageous for the filaments B to have a melting point of below 220° C., preferably of 110° to 220° C., in particular of from 150° to 200° C.

It is thus essential for the present invention to use filament varieties A, B satisfying certain melting point targets.

The melting point of the filaments is determined on the polymer raw material used for making them. A special feature of many polymer materials, including, for example, polyester materials, is that they generally soften before melting and the melting process extends over a relatively large temperature range. It is nonetheless possible to determine readily reproducible temperature points which are characteristic of these polymer materials, for example polyester materials, at which the sample under investigation loses its geometric shape, i.e. passes into a liquid (albeit frequently highly viscous) state. The determination of these characteristic temperature points is effected using so-called penetrometers (analogously to DIN 51579 and 51580), where a measuring tip of defined dimension is placed under defined pressure onto a chip or pellet of the polymer sample to be investigated, the sample is then heated up at a defined heating-up rate, and the penetration of the measuring tip into the polymer material is monitored and measured.

As soon as the sample, for example the polyester sample, softens, the measuring tip begins to penetrate very slowly into the material.

The penetration of the measuring tip can slow down again at increasing temperature and even cease completely, if the softened, initially amorphous, polyester mass crystallizes.

In this case, a further increase in the temperature will reveal a second softening range which then turns into the below-described "melting range".

Said "melting range" is a certain fairly narrow temperature range characteristic of the material, in which a pronounced acceleration of the penetration of the measuring tip into the polyester material takes place. A temperature point can then be defined as a readily reproducible melting point when the measuring tip has reached a certain penetration.

A melting point for the purposes of this invention is that temperature point (average of 5 measurements) at which a measuring tip with a circular contact area of 1 $mm^2$ and a contact weight of 0.5 g has penetrated 1000 μm into a polymer sample, for example a polyester sample, heated up at 5° C./min.

Not only for reasons specific to the production of the pile material of the present invention but also for reasons of a particularly advantageous distribution of the matrix material in the course of the consolidation of the backing (short flow paths), it is preferable for bundle coherency to exist between the filaments A and B and any C.

Bundle coherency between the filaments is necessary to form a thread structure which can be processed in the manner of a yarn, i.e. which can be woven or knitted, for example, without individual filaments of the assembly coming out of the assembly or forming major loops and thus leading to disruptions of the processing steps.

The required bundle coherency can be brought about for example by imparting to the yarn a so-called protective twist of, for example, 10 to 100 turns/m or by spot-welding the filaments together. Preferably, the required bundle coherency is brought about by interlacing in a jet in which the filaments to be cohered together into a yarn are blasted from the side by a fast-moving jet of gas while passing through a narrow yarn passageway. The degree of interlacing and hence the degree of bundle coherency can be varied by varying the force of the gas jet.

Preferably, the filaments A, B and any C of the multifilament hybrid yarn are interlaced, the degree of interlacing of the multifilament hybrid yarn advantageously corresponding to an entanglement spacing of 10 to 100 mm.

The degree of interlacing is characterized in terms of the entanglement spacing measured with an Itemat needle tester in accordance with the needle test method described in U.S. Pat. No. 2,985,995.

Further preferred features of the multifilament hybrid yarn, which according to the application requirements or for convenience may be present individually or in varying combinations, are that the filaments B are flat, that the multifilament hybrid yarn contains no cofilaments C, that it has a linear density of 80 to 500 dtex, preferably 100 to 400 dtex, in particular 160 to 320 dtex, that the higher-melting textured filaments A have a filament linear density of 0.5 to 15 dtex, preferably of 2 to 10 dtex, and that the lower-melting filaments B have a filament linear density of 1 to 20 dtex, preferably of 3 to 15 dtex.

In the interests of good textile quality on the part of the pile material of the present invention, it is advantageous to use a multifilament hybrid yarn whose higher-melting textured filaments A have an initial modulus of 15 to 28 N/tex, preferably of 20 to 25 N/tex, and a tenacity of above 25 cN/tex, preferably of above 30 cN/tex, in particular of 30 to 40 cN/tex.

It is advantageous, in particular in relation to the production of novel pile materials having darker shades, to use a backing which has likewise been dyed in darker shades. If the backing is significantly lighter in color than the pile, it may happen that brushing across the pile or laying the pile material over structures with a low radius of curvature will cause the lighter-colored backing to shine through the pile.

It is therefore preferred that the higher-melting textured filaments A be dyed, preferably spun-dyed.

The lower-melting filaments B can be spun-dyed or preferably ecru, since it has been found that, on thermal consolidation of the backing, the material of the filaments B is very substantially taken up by the strands of the filaments B, together producing the dark color of the filaments A.

It has been found that, in the making of the backing, other yarns can be used as well as the multifilament hybrid yarn to be used according to the present invention. Advantageously, however, the proportion of the multifilament hybrid yarn in the backing should be at least 30%, preferably at least 75%, in particular 100%.

For most applications it is advantageous for the basis weight of the pile material of the present invention to be 100 to 1000 g/m$^2$, preferably 200 to 500 g/m$^2$ and for the weight ratio of the textile backing to pile yarn in the raw state material to be within the range from 20:80 to 40:60.

It is further advantageous for the loops to have a length of 1.0 to 6.0 mm, preferably a length of 2.8 to 3.5 mm in the case of shear plush, preferably a length of 1.0 to 2.5 mm in the case of short-loop plush.

In general, the pile material of the present invention will meet the requirements of an interior decoration material when the pile yarn has a yarn linear density of 50 to 800 dtex, preferably 100 to 400 dtex.

At the same time the filament linear density of the pile yarn is normally 0.5 to 10 dtex, preferably 0.7 to 6 dtex, in particular 3 to 6 dtex.

Having regard to the textile character of the pile material of the present invention it is preferable for the pile yarns to be textured, preferably jet or false-twist textured.

The pile itself can consist of uncut pile yarn loops or of cut pile yarn ends.

As mentioned above, one embodiment of the pile material of the present invention has a knitted fabric as textile backing.

In this embodiment, the backing of the pile material of the present invention can be knitted with synchronous or consecutive course formation.

The textile sheets knitted with synchronous course formation can be warp-knitted or weft-knitted. A knitted backing can have a rib, purl or plain construction and their known variants and also jacquard patterning.

Rib construction also comprehends, for example, its variants of plated, openwork, ribbed, shocked, wave, tuckwork, knob and also the interlock construction of one×one rib crossed.

Purl construction also comprehends, for example, its variants of plated, openwork, interrupted, shocked, translated, tuckwork or knob.

Plain construction also comprehends, for example, its variants of plated, floating, openwork, plush, inlay, tuckwork or knob.

As likewise already mentioned above, a further embodiment of the pile material of the present invention has a woven backing.

In principle, a woven backing may have any known weave construction, such as plain weave and its derivatives, for example rib, basket, huckaback or mock leno, twill and its many derivatives, of which only herringbone twill, flat twill, braid twill, lattice twill, cross twill, peak twill, zigzag twill, shadow twill or shadow cross twill will be mentioned as examples. (For the weave construction designations cf. DIN 61101)

The woven or knitted constructions are chosen according to the use intended for the textile material of the present invention, usually from purely technical criteria, but occasionally also from decorative aspects. The preferred knitted structure is rib, purl or plain, while the preferred woven structure is plain with or without simple derivations without major floats.

Preference in each case is given to the basic structures of the knit or wovens.

The density of the backing sheet will vary, depending on the use for which the material is intended and depending on the linear density of the yarns used, within the range from 10 to 25 threads/cm, preferably 14 to 20 threads/cm in warp and weft in the case of woven fabrics; or around a corresponding stitch density of about 12 to 30 needles/inch, preferably 16 to 24 needles/inch in the case of knitted material. Within this range, the densities can of course be adapted to the intended application.

Depending on the requirements of the application and in particular the structure decor desired for the pile, at least 30%, preferably 60 to 100%, of the stitches in a knitted backing will comprise pile yarns. For the same reason it can be advantageous, in the case of a woven backing, that not every warp and/or weft thread should bind in pile tufts. In general, in the case of a woven backing, 30%, preferably 60 to 100%, of the warp and/or weft threads bind in pile tufts.

Specific control of the binding of pile tufts into the backing sheet makes it possible to create very decorative plushes with interesting surface structures and decors. Such products are known as structural plush.

The structure and production of these decorative structural plushes, with a woven backing or a backing of knitted material, will hereinafter be described with reference to a backing knitted with consecutive course formation. The structure described can mutatis mutandis and analogously also be applied to pile materials having a woven backing.

Owing to the use in the present invention of the multifilament hybrid yarn, a woven backing too will result in a three-dimensionally deformable pile material to be consolidated by heat.

Such a particularly preferred decorative plush construction consists of a knitted structural plush of high deformability, composed of base and loop yarns, the loop yarns being filament yarns which, based on a machine gauge of 18 or 20 needles per inch, have a linear density of 300–400 dtex, preferably 345–360 dtex; whose base yarn, based on a machine gauge of 18 or 20 needles per inch, has a linear density of 300 to 370 dtex, preferably 320–350 dtex, the filament linear density being greater than 1.5 dtex, preferably greater than 2.5 dtex; whose basis weight is about 350 to 550 g/m$^2$; and whose base meshes contain no loop yarn in structure zones.

Structure zones for the purposes of this invention are regions in which the knitted plush of the present invention has no loops.

Similarly, the base yarns suitable for producing the structural plush likewise consist advantageously of synthetic filaments. Suitable filament materials for base and loop yarns are for example polyester, polyamide or polyacrylonitrile filaments; preference is given to polyester filaments. If there are no special application requirements for the use of different materials in loop yarn and base yarn, it is preferable to use polyester filament yarns for both. Advantageously, all the filaments in the pile yarn have a melting point which is at least 20° C., preferably at least 40° C., in particular at least 80° C., above the melting point of said filaments B of said multifilament hybrid yarn. If there are special reasons why this is not the case, care must be taken with the consolidation of the backing of the pile material of the present invention to ensure that the heat treatment be restricted to the backing of the material, for example by contact heating against a hot surface, in order that any harshening of the pile yarn may be avoided.

Textured yarns are preferred, in particular for yarn and filament linear densities at the lower end of the specified linear density range. It is particularly advantageous in this connection for base yarns to be false-twist textured and loop yarns to be false-twist or air-jet textured.

The structural plushes of the present invention may also consist of or comprise combination yarns composed of flat and textured filaments.

Suitable yarns within the above-specified linear density range are for example known, in various grades, under the commercial name (R)TREVIRA TEXTURED.

As observed above, the above-specified yarn linear densities of the base and loop yarns present in the structural plush of the present invention relate to a stitch density corresponding to a machine gauge of 18 or 20 needles per inch. In the case of a finer machine gauge, the base and loop yarn linear densities are correspondingly reduced.

The filament linear densities of the base and loop yarns are above 1.5 dtex and should advantageously exceed 5 dtex only in the case of special demands on the plush. The linear density selection within this range depends on the one hand on the properties desired for the structural plushes of the present invention. Structural plushes constructed from yarns, especially loop yarns, having filament linear densities below 3 dtex are softer, denser and silkier than those constructed from yarns having higher filament linear densities. On the other hand, as well as quality and fastness requirements, there are also economic aspects to be taken into account in linear density selection. It is advantageous, then, unless other requirements demand otherwise, to use yarns having filament linear densities of 2.5 dtex to 5 dtex, in particular commercially available standard grades.

For particularly high qualities and especially if a very appealing appearance and pleasant hand are desired, it is preferable to use profile filaments such as, for example, those having an oval, dumbbell-shaped or ribbon-shaped cross-section, which may additionally include one or more constrictions, or three-edge, trilobal and in particular octolobal profiles.

The loop proportion in the structural plush of the present invention varies with the design within the range from 40–75%, preferably 45–60%, in particular at about 50%. The "loop proportion" in question here is the proportion in % of the loops present in the repeat relative to the maximum number of loops possible in the same area of the base material in the case of a full plush.

$$\text{Loop proportion [\%]} \frac{\text{Number of loops in repeat} \times 100}{\text{Number of possible loops in full plush}}$$

Whereas in conventional knitted plushes the weight proportion of the base material amounts to about 25–28% by weight of the total weight, the weight proportion of the base material in the structural plush of the present invention amounts to 40–45% by weight, because of the high linear density not only in the loop but also in the base yarn and on account of its above-described very compact construction, and can even be higher depending on the design, i.e. in the case of a lower loop proportion.

To create the surface design, the stitches of the base material can be combined in patterns with loops, which is achieved through appropriate jacquardwise needle selection on the part of the knitting machine, or complete base courses without loops can be present.

For example, 1 to 5 loop courses can be followed by one or two courses without loops (cross rib effect). Even patterns having a weavelike character can be produced in this way. Designs produced in this way with longitudinal and/or transverse and/or diagonal alleys, which act as a kind of venting ducts, make a significant contribution to seat comfort when these structural plushes are used as seat covers.

Owing to the abovementioned features, in particular the high density of the base weave, the high yarn thickness in base and loop yarn and the resulting high pile density, but also by virtue of an optionally applied finish additionally stabilizing the pile and the very good pile integrity resulting therefrom, the structural plushes of the present invention exhibit very good stability, even in critical designs.

It is of particular application significance that, despite the very compact, dense fabric construction, the extensibility and the reversible and irreversible deformability of the structural plush of the present invention can still be adapted to the application requirements within wide limits by a setting of the knitting machine (fabric firmness), the choice of the elasticity and/or crimp of the base yarn and/or an after-treatment of the structural plush, for example by a shrinkage treatment adapted to the desired deformability. The extensibility is set in line with the degree of deformation necessary in the further processing to three-dimensionally shaped articles, for example seat covers or specific deep-drawn lining elements, for example in a car interior.

The freedom to set the extensibility means for the structural plushes of the present invention not only easier manufacture but also an additional quality advantage over the almost or completely inelastic fabrics woven from flocked yarns. The latter can be given a certain deformability only by employing complicated constructions and special yarns of high extensibility.

The pile of the structural plushes of the present invention is preferably sheared down to about 1 to 3 mm. This results in a further economic advantage in that the excellent pile integrity due to the high thickness of base and loop yarns permits economical shearing and thus contributes to the economically highly desirable reduction in the shearing loss, which is about 20 to 30% by weight in the prior art, but only 10 to 15% by weight in the structural plush of the present invention.

By means of a low pile height, the structural plush of the present invention can also be used to create a flocked fabric appearance.

The high density of the base material of the structural plush of the present invention has the further advantage that it has an appreciably reduced penetrability for molding compositions and therefore can be used with special advantage in shape-conferring processes involving direct composite molding with or without foam, in many cases without the otherwise necessary penetration-barring skin.

As mentioned above, the backing of the pile material of the present invention is constructed from a multifilament hybrid yarn comprising higher-melting (A) and lower-melting filaments (B), subject to the provisos that the melting points are a certain, technically dictated minimum distance apart and that filaments A are textured. These features are necessary, but also sufficient, in order to impart to the pile material of the present invention, and its backing, the ability to deform and the capacity for thermoconsolidation.

The filaments A of the multifilament hybrid yarn are subject to the requirement that they melt above 180° C., preferably above 220° C., in particular above 250° C. In principle they may consist of all spinnable materials meeting these requirements. Suitable are therefore not only natural polymer materials, for example filaments of regenerated cellulose or cellulose acetate, but also synthetic polymer filaments, which, because their mechanical and chemical properties are widely variable, are particularly preferred.

For instance, in principle, filaments A can consist of high performance polymers, such as, for example, polymers which, without or with only minimal drawing possibly after a heat treatment following the spinning operation, yield filaments having a very high initial modulus and a very high breaking strength (=tenacity). Such filaments are described in detail in Ullmann's Encyclopedia of Industrial Chemistry, 5th edition (1989), Volume A13, pages 1 to 21 and also Volume 21, pages 449 to 456. They consist for example of liquid-crystalline polyesters (LCP), polybenzimidazole (PBI), polyetherketone (PEK), polyetheretherketone (PEEK), polyetherimides (PEI), polyether sulfone (PESU), aramids such as poly(m-phenyleneisophthalamide) (PMIA), poly(m-phenyleneterephthalamide) (PMTA) or poly(phenylene sulfide) (PPS).

Generally, however, the use of such high-performance fibers is not necessary, nor advantageous having regard to the strength requirements of the backing material of the pile material of the present invention.

Advantageously, therefore, the filaments A consist of regenerated or modified cellulose, higher-melting polyamides (PA), for example 6-PA or 6,6-PA, polyvinyl alcohol, polyacrylonitrile, modacrylic polymers, polycarbonate, but in particular polyesters. Polyesters are suitable in particular for use as raw material for the filaments A because it is possible, in a relatively simple manner, through modification of the polyester chain, to vary the chemical, mechanical and other physical application-relevant properties, in particular, for example, the melting point.

Suitable polymer materials for the lower-melting filaments (B) likewise advantageously include spinnable polymers, for example vinyl polymers such as polyolefins, such as polyethylene or polypropylene, polybutene, lower-melting polyamides, for example 11-PA, or alicyclic polyamides (for example the product obtainable by condensation of 4,4'-diaminodicyclohexylmethane and decanecarboxylic acid), but in particular here too modified polyesters having a reduced melting point.

The pile yarns substantially determine the textile character of the pile material of the present invention. They can consist of all fiber and filament materials customarily used for producing the pile of pile materials, for example of plushes. For instance, the pile yarns can consist of staple fibers composed of natural fiber materials, for example cotton or wool, or composed of man-made natural polymer fiber materials, or else of synthetic fibers and filaments. Similarly, blends of natural and synthetic fibers can be present in the pile yarn if this meets the requirements of the end-user. The pile yarns are generally dyed, for example spun-dyed, and frequent use is made of yarns having different colorings in order to achieve certain decorative effects. Preferably, the pile yarns are textured.

As explained earlier, it is particularly advantageous for the higher-melting textured filaments A to be polyester filaments and that it is then particularly advantageous for also the lower-melting filaments B to consist of modified polyester having a reduced melting point.

In a preferred embodiment of the present invention, the pile yarn consists of the same polymer class as the backing yarns. It is particularly preferable for the pile yarn to be a polyester yarn.

Preferably, all the filaments present in the pile yarn have a melting point which is at least 20° C., preferably at least 40° C., in particular at least 80° C., above the melting point of said filaments B of said multifilament hybrid yarn. If this condition is not met, the pile may coconsolidate and stiffen in the course of the thermal consolidation of the backing and hence lose its textile character, unless the heat-setting of the backing is carried out in such a way that only the backing assumes the temperature necessary for consolidation, for example through contact heating of the backing.

If the backing yarn and the pile yarn consist essentially of the same polymer class, appreciable advantages result with respect to the disposal of the used material. This is because such a single-material product is particularly simple to recycle, for example by simple melting and regranulation.

If the polymer material of backing and pile is polyester, it is additionally possible to recover useful raw materials from the used products, for example by alcoholysis, for producing virgin polyesters. Polyesters for the purposes of this invention also include copolyesters constructed from more than one variety of dicarboxylic acid radical and/or more than one variety of diol radical.

A polyester from which the fiber materials of the pile material of the present invention are made contains at least 70 mol %, based on the totality of all polyester structural units, of structural units derived from aromatic dicarboxylic acids and from aliphatic diols, and not more than 30 mol %, based on the totality of all polyester structural units, of dicarboxylic acid units which differ from the aromatic dicarboxylic acid units which form the predominant proportion of the dicarboxylic acid units or are derived from araliphatic dicarboxylic acids having one or more, preferably one or two, fused or unfused aromatic nuclei, or from aliphatic dicarboxylic acids having in total 4 to 12 carbon atoms, preferably 6 to 10 carbon atoms, and diol units derived from branched and/or longer-chain diols having 3 to 10, preferably 3 to 6, carbon atoms or from cyclic diols, or from diols which contain ether groups or, if present in a minor amount, from polyglycol having a molecular weight of about 500–2000.

Specifically, the polyester of the core, based on the totality of all polyester structural units, is composed of 35 to 50 mol % of units of the formula —CO—$A^1$—CO— (I)

0 to 15 mol % of units of the formula —CO—$A^2$—CO— (II)

35 to 50 mol % of units of the formula —O—$D^1$—O— (III)

0 to 15 mol % of units of the formula —O—$D^2$—O— (IV)

and 0 to 25 mol % of units of the formula —O—$A^3$—CO— (V)

where $A^1$ denotes aromatic radicals having 5 to 12, preferably 6 to 10, carbon atoms, $A^2$ denotes aromatic radicals other than $A^1$ or araliphatic radicals having 5 to 16, preferably 6 to 12, carbon atoms or aliphatic radicals having 2 to 10 carbon atoms, preferably 4 to 8 carbon atoms, $A^3$ denotes aromatic radicals having 5 to 12, preferably 6 to 10, carbon atoms, $D^1$ denotes alkylene or polymethylene groups having 2 to 4 carbon atoms or cycloalkane or dimethylenecycloalkane groups having 6 to 10 carbon atoms, $D^2$ denotes non-$D^1$ alkylene or polymethylene groups having 3 to 4 carbon atoms or cycloalkane or dimethylenecycloalkane groups having 6 to 10 carbon atoms or straight-chain or branched alkanediyl groups having 4 to 16, preferably 4 to 8, carbon atoms, or radicals of the formula —$(C_2H_4—O)_m—C_2H_4$—, where m is an integer from 1 to 40, m=1 or 2 being preferred for proportions up to 20 mol % and groups having m=10 to 40 being preferably present only in proportions of below 5 mol %, the proportions of the basic units I and III and of the modifying units II, IV and V being selected within the framework of the above-specified ranges so that the polyester has the desired melting point.

The novel pile material whose fiber materials consist of such polyesters, in particular polyethylene terephthalate, are not readily flammable.

The low flammability may be additionally enhanced by using flame retardant polyesters. Such flame retardant polyesters are known. They include additions of halogen compounds, in particular bromine compounds, or, particularly advantageously, they include phosphorus compounds cocondensed in the polyester chain. Particularly preferred flame retardant pile materials of the present invention include in the backing and/or pile yarns composed of polyesters including, cocondensed in the chain, units of the formula

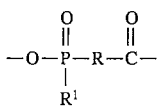

(VI)

where R is alkylene or polymethylene having 2 to 6 carbon atoms or phenyl and $R^1$ is alkyl having 1 to 6 carbon atoms, aryl or aralkyl.

Preferably, in the formula VI, R is ethylene and $R^1$ is methyl, ethyl, phenyl or o-, m- or p-methylphenyl, in particular methyl.

The units of the formula VI are advantageously present in the polyester chain up to 15 mol %, preferably in a proportion of 1 to 10 mol %.

It is of particular advantage for the polyesters used not to contain more than 60 meq/kg, preferably less than 30 meq/kg, of capped carboxyl end groups and less than 5 meq/kg, preferably less than 2 meq/kg, in particular less than 1.5 meq/kg, of free carboxyl end groups.

Preferably, therefore, the polyester has, for example by reaction with mono-, bis- and/or polycarbodiimides, capped carboxyl end groups. In a further embodiment, having regard to prolonged hydrolysis stability, the polyester of the core and the polyester of the polyester mixture of the sheath comprises not more than 200 ppm, preferably not more than 50 ppm, in particular from 0 to 20 ppm, of mono- and/or biscarbodiimides and from 0.02 to 0.6% by weight, preferably from 0.05 to 0.5% by weight, of free polycarbodiimide having an average molecular weight of 2000 to 15,000, preferably of 5000 to 10,000. The polyesters of the yarns present in the pile material of the present invention may in addition to the polymer materials include up to 10% by weight of nonpolymeric substances, such as modifying additives, fillers, delusterants, color pigments, dyes, stabilizers, such as UV absorbers, antioxidants, hydrolysis, light and temperature stabilizers and/or processing aids.

The present invention also provides the consolidated above-described pile materials, i.e. those in which the lower-melting filaments B of the multifilament hybrid yarn of the textile backing form at least partially a matrix which interconnects the higher-melting textured filaments of the multifilament hybrid yarn to one another and to the pile yarn in the region of the plane of the backing.

It is a special characteristic of this material that not only the backing is consolidated by at least partial matrix formation of said filaments B of said multifilament hybrid yarn of said backing, but also, surprisingly, the anchorage of the pile yarn in the backing is stronger than the tensile strength of the pile yarn.

The present invention further provides a multifilament hybrid yarn consisting of at least 2 varieties A and B of filaments with or without cofilaments C, wherein said filaments A are textured and have a melting point above 180° C., preferably above 220° C., in particular above 250° C., said filaments B are flat and have a melting point below 220° C., preferably below 200° C., in particular below 180° C., the melting point of said filaments B being at least 20° C., preferably at least 40° C., in particular at least 80° C., below the melting point of said filaments A, and the weight ratio of said filaments A:B being within the range from 20:80 to 80:20, preferably from 40:60 to 60:40, and the multifilament hybrid yarn additionally containing up to 40% by weight of cofilaments C.

The present invention further provides a process for producing a pile material, to be consolidated thermally, composed of a textile backing composed of a knit or woven and bound-in loop-forming pile yarns by weaving or knitting a fabric with bound-in loops or by weaving or knitting a double fabric, in which case the two textile sheets are interconnected by loop yarns, and subsequently separating the two textile sheets in such a way as to form two one-sheet pile wovens or knits, which comprises feeding the weaving or knitting machine with a yarn to form the textile backing sheets of the pile material which is at least 30%, preferably at least 75%, a multifilament hybrid yarn consisting of at least 2 varieties A and B of filaments with or without cofilaments C, wherein said filaments A are textured and have a melting point above 180° C., preferably above 220° C., in particular above 250° C., said filaments B have a melting point below 220° C., preferably below 200° C., in particular below 180° C., the melting point of said filaments B being at least 20° C., preferably at least 40° C., in particular at least 80° C., below the melting point of said filaments A, and the weight ratio of said filaments A:B being within the range from 20:80 to 80:20, preferably from 40:60 to 60:40, and the multifilament hybrid yarn additionally containing up to 40% by weight of cofilaments C.

Subsequently the pile woven or knit obtained is subjected to a consolidating heat treatment, which may be an optionally integral part of the process of the present invention, at a temperature at which said lower melting filaments B of said multifilament hybrid yarn soften. The consolidated pile material thus produced is likewise part of the subject-matter of the present invention.

The temperature of the final heat treatment and the treatment duration depend on the desired degree of consolidation and the melting point of the filaments B of the multifilament hybrid yarn.

In general, the heat treatment is carried out at 100° to 200° C., preferably at 120° to 180° C.

In practice, it will be found very advantageous when the raw state material of the pile woven or knit produced is pre-set on a tenter at a relatively low temperature, for example by steaming.

This eliminates the curling tendency of the raw state material; it becomes more compliant for the further processing step, and the pile becomes better anchored (loop stabilization) and so is better able to resist mechanical tensile stresses. A particular advantage associated with pre-setting is that no lamination is necessary to force planarity and little, if any, edge-cutting waste is produced.

It is therefore preferable when the raw state material of the pile woven or knit produced is pre-set on a tenter. Preferably the filaments B in the multifilament hybrid yarns used for forming the backing are flat.

Furthermore, the process is controlled in accordance with the requirements of practical performance in such a way that the pile material has a basis weight from 100 to 1000 g/m$^2$, preferably 200 to 500 g/m$^2$ and the feed ratio of backing yarn to pile yarn is within the range from 20:80 to 40:60.

The process is controlled in such a way according to the desired pile density and patterning that a knitted backing will have pile yarns in at least 30%, preferably 60 to 100%, of the stitches, while a woven backing will have pile tufts bound in by 30%, preferably 60 to 100%, of the warp and/or weft threads.

The production of the preferred knitted structural plush of the present invention is effected by knitting a base yarn and a loop yarn, finishing the knit and shearing the pile, and comprises using for the formation of the backing an above-described multifilament hybrid yarn and effecting the knitting on knitting machines with system-wise separate incorporation of base and loop yarns and jacquardwise needle selection and a machine gauge of 18, 20 or 24 needles/inch, preferably 18 or 20 needles/inch, the loop yarns used being polyester filament yarns which, based on a machine gauge of 18 or 20, have a linear density of 300–400 dtex, preferably 345–360 dtex, the base yarns used have, based on a machine gauge of 18 or 20 needles/inch, a linear density of 300 to 370 dtex, preferably 320–350 dtex, the filament linear density being greater than 1.5 dtex, preferably greater than 2.5 dtex, and knitting is carried out to a basis weight of about 350 to 550 g/m$^2$.

The resulting novel pile material to be consolidated by heat treatment can be converted into the novel consolidated pile material by the above-described heat treatment.

The yarn selection and the selection of the filament linear densities of the base and loop yarns are effected according to the above-specified criteria.

The loop proportion in the structural plush of the present invention is set to 40–70% depending on the design and hence is distinctly below the loop proportion of known plushes.

Special designs can be produced in a specific manner not only via jacquardwise selection but also by means of complete base rows without loops. For example, 1 to 5 loop rows can be followed by one or two rows without loops.

Similarly, patterns having a weavelike character and designs with longitudinal, transverse and/or diagonal alleys can be produced in this way.

The pattern is predominantly selected according to esthetic criteria. As already explained above, it is also possible to produce surfaces with a typical resemblance to woven velour.

The visual appearance of the structural plushes is strongly influenced by a suitable choice of color in base and loop yarn; color contrasts emphasize the structure character, in particular when base and loop yarns have contrast colors.

This structural plush according to the invention is finished in a conventional manner so as to produce a clean pile and a high-contrast appearance.

The present invention also provides a process for producing a multifilament hybrid yarn by mixing at least two yarns A and B with or without further coyarns C and subsequent performance of a bundle-cohering operation, wherein said filaments A are textured and have a melting point above 180° C., preferably above 220° C., in particular above 250° C., said filaments B have a melting point below 220° C., preferably below 200° C., in particular below 180° C., the melting point of said filaments B being at least 20° C., preferably at least 40° C., in particular at least 80° C., below the melting point of said filaments A, and the weight ratio of said filaments A:B being within the range from 20:80 to 80:20, preferably from 40:60 to 60:40, and the multifilament hybrid yarn additionally containing up to 40% by weight of cofilaments C.

The bundle-cohering operation is preferably effected by air jet interlacing. It is further preferable not to use any cofilaments C in the production of the multifilament hybrid yarn.

In the preferred embodiment, the pile material of the present invention is a single-product material and therefore has the above-described advantages in respect of disposal/recycling. In addition, the present invention affords further advantages, namely the saving of the application of a skin prior to further processing, the possibility to stiffen the backing and at the same time densify it so as to make possible direct composite molding, for example with foams, without the foam striking through to the pile side. It is particularly advantageous that the pile material, even with a woven backing, possesses very good three-dimensional deformability which results from the use of the hereindescribed multifilament hybrid yarn in the production of the backing.

The examples which follow illustrate the production of the multifilament hybrid yarn of the present invention and its use in the production of unstructured and structured (structural plush) pile materials according to the present invention.

EXAMPLE 1

Production of the base yarn used for the backing:

A hybrid yarn is produced by folding a 110 dtex 32 filament spun-dyed, textured, unmodified polyethylene terephthalate (raw material melting point 265° C.) yarn ((R)TREVIRA Type 536) with a 140 dtex 24 filament yarn composed of polyethylene terephthalate modified with isophthalic acid (raw material melting point 110° to 120° C.) and comingling in an interlacing jet operated using an air pressure of 2 bar, leaving the lower-melting yarn essentially flat.

EXAMPLE 2

An MCPE circular knitting machine with jacquard means with 20 needles/inch and a cylinder diameter of 26" and 3.5 mm sinkers is used to produce a knitted fabric with a loop proportion of 100% using a loop yarn/base yarn feed ratio of 75%:25%.

Construction: two-colored jacquard, 14 full courses with base yarn, 28 loop courses.

The base yarn used is a multifilament hybrid yarn obtained as per the description in Example 1, while the loop yarn used is an 84 dtex 24 filament×2 textured (R)TREVIRA polyester color yarn having an octolobal cross section.

The knitted hose thus obtained is slit as usual to form a knitted fabric having a width of 172 cm and a basis weight of 380 $gm^2$. The raw state material is steamed on a tenter at no more than 120° C. to achieve a pre-stabilization.

The material is then sheared (2 passes), washed (open-width wash 50° C.), tenter-dried and -set at 150° C. and finished.

The finished material has a width of 165 cm and a basis weight of 330 $g/m^2$.

Owing to the use of the multifilament hybrid yarn, the otherwise customary edge cutting and gluing is not necessary, since the material lies perfectly flat.

EXAMPLE 3

A circular knitting machine with jacquard means with 20 needles/inch and a cylinder diameter of 26" and 3.5 mm sinkers is used to produce a knitted fabric with a loop proportion of 50% and a loop yarn/base yarn feed ratio of 55%:45%, the loop being knitted in a diamond pattern of 3×6 stitches.

The base yarn used is a multifilament hybrid yarn obtained analogously to the description in Example 1 (starting yarns are: higher-melting type: 220 dtex 40 filament polyethylene terephthalate melting point 265° C.; lower-melting type: 140 dtex 24 filament isophthalic acid-modified polyethylene terephthalate melting point 110° C.), while the loop yarn used is a 167 dtex 48 filament×2 (R)TREVIRA polyester yarn octolobal.

The knitted hose thus obtained is slit as usual to leave a knitted fabric having a width of 182 cm and a basis weight of 489 $g/m^2$. The raw state material is steamed on a tenter at not more than 120° C. to achieve pre-stabilization.

The material is then sheared (2 passes), washed (width wash 50° C.), tenter-dried and -set at 150° C. and finished. The finished material has a width of 170 cm and a basis weight of 446 $g/m^2$. The shearing loss is 10.4%.

EXAMPLE 4

A circular knitting machine with jacquard means with 20 needles/inch and a cylinder diameter of 26" and 3.5 mm sinkers is used to produce a knitted fabric with a loop proportion of 72% and a loop yarn/base yarn feed ratio of 61.5%:38.5%, the loop being knitted in a diagonal jacquard pattern.

The base yarn used is a multifilament hybrid yarn obtained analogously to the description in Example 1 (starting yarns are: higher-melting type: 220 dtex 40 filament polyethylene terephthalate melting point 265° C.; lower-melting type: 140 dtex 24 filament isophthalic acid-modified polyethylene terephthalate melting point 110° C.), while the loop yarn used is a 110 dtex 32 filament×3 (R)TREVIRA velour, PMC polyester yarn octolobal.

The raw state material is steamed on a tenter at not more than 120° C. to achieve pre-stabilization.

The material is then sheared (2 passes), washed (width wash 50° C.), tenter-dried and -set at 150° C. and finished. The finished material has a basis weight of 435 $g/m^2$. The shearing loss is 13.3%.

EXAMPLE 5

A circular knitting machine with jacquard means with 20 needles/inch and a cylinder diameter of 26" and 3.5 mm sinkers is used to produce a knitted fabric with a loop proportion of 50% and a loop yarn/base yarn feed ratio of 58%:42%, the loop being knitted in a diamond pattern of 3×6 stitches.

The base yarn used is a multifilament hybrid yarn obtained analogously to the description in Example 1 (starting yarns are: higher-melting type: 220 dtex 40 filament polyethylene terephthalate melting point 265° C.; lower-melting type: 140 dtex 24 filament isophthalic acid-modified polyethylene terephthalate melting point 110° C.), while the loop yarn used is a 365 dtex 128 filament (R)TREVIRAJet-Tex polyester yarn octolobal.

The knitted hose thus obtained is slit as usual to leave a knitted fabric having a width of 180 cm and a basis weight of 518 $g/m^2$. The raw state material is steamed on a tenter at not more than 120° C. to achieve pre-stabilization.

The material is then sheared (2 passes), washed (width wash 50° C.), tenter-dried and -set at 150° C. and finished. The finished material has a width of 170 cm and a basis weight of 506 $g/m^2$. The shearing loss is 11.4%.

What is claimed is:

1. A multifilament hybrid yarn consisting of at least 2 varieties A and B of filaments with or without cofilaments C, wherein said filaments A
are textured and have a melting point above 180° C., said filaments B
are flat and have a melting point below 220° C., the melting point of said filaments B being at least 20° C. below the melting point of said filaments A, and the weight ratio of said filaments A:B being within the range from 20:80 to 80:20, and the multifilament hybrid yarn additionally containing up to 40% by weight of cofilaments C.

2. The multifilament hybrid yarn of claim 1, wherein said higher melting textured filaments A have a crimp of 3 to 50%.

3. The multifilament hybrid yarn of claim 2, wherein said higher melting textured filaments A have a crimp of 8 to 30%.

4. The multifilament hybrid yarn of claim 3, wherein said higher melting textured filaments A have a crimp of 10 to 22%.

5. The multifilament hybrid yarn of claim 1, wherein said filaments A have a melting point of 220° to 300° C.

6. The multifilament hybrid yarn of claim 5, wherein said filaments A have a melting point of 240°–280° C.

7. The multifilament hybrid yarn of claim 1, wherein said filaments B have a melting point of 110° to 220° C.

8. The multifilament hybrid yarn of claim 7, wherein said filaments B have a melting point of 150° to 200° C.

9. The multifilament hybrid yarn of claim 1, wherein bundle coherency exists between said filaments A and B and any C.

10. The multifilament hybrid yarn of claim 1, wherein said multifilament hybrid yarn contains no cofilaments C.

* * * * *